United States Patent [19]

Ivey

[11] 4,333,148

[45] Jun. 1, 1982

[54] PROCESS LINE PROGRESSIVE DRAW CONTROL SYSTEM

[75] Inventor: Curtis L. Ivey, Amherst, N.Y.

[73] Assignee: Westinghouse Electric Corp., Pittsburgh, Pa.

[21] Appl. No.: 98,002

[22] Filed: Nov. 28, 1979

[51] Int. Cl.[3] ..... G06G 7/66; B21B 37/00

[52] U.S. Cl. ..... 364/469; 72/8; 72/11; 364/472

[58] Field of Search ..... 72/6, 8, 9, 11, 19, 72/205; 364/469, 471, 472

[56] References Cited

U.S. PATENT DOCUMENTS

| | | | |
|---|---|---|---|
| 3,332,263 | 7/1967 | Beadle et al. | 364/472 X |
| 3,768,286 | 10/1973 | Peterson | 72/9 |
| 4,003,230 | 1/1977 | Morooka et al. | 72/19 |
| 4,011,743 | 3/1977 | Peterson et al. | 364/469 X |
| 4,063,438 | 12/1977 | Sekiguchi | 72/6 |
| 4,080,656 | 3/1978 | Jonsson et al. | 364/471 |
| 4,087,859 | 5/1978 | Anbe | 364/472 |
| 4,137,742 | 2/1979 | Tanifuji et al. | 364/472 X |

*Primary Examiner*—Joseph F. Ruggiero
*Attorney, Agent, or Firm*—C. M. Lorin

[57] ABSTRACT

A draw control system for a process line is provided wherein the process line comprises a number of stand or sections having the speeds $N_1$, $N_2$–$N_n$. The stands are provided with a master reference voltage V which may be modified at each section to change its speed to $N_n+\Delta N_n$ where n=1–2, 3–n. One section is selected as a no-draw section, i.e., the master voltage is applied without change to the speed regulator for that section to determine its speed, say $N_1$. All succeeding sections comprise non-inverting summation operational amplifiers arranged in cascade respectively so that the output of one determines the speed for its section and this output is also applied to the input of the non-inverting summation amplifier for the succeeding section. With this arrangement all perturbations ripple on through the draw control system so that interstand tension is maintained under all conditions. Thus, if the master reference voltage is changed to $V+\Delta V$ then $$\frac{\Delta N_1}{N_1} = \frac{\Delta N_n}{N_n} = \frac{\Delta V}{V}$$

and if $N_{n-2}$ is changed to $N_{n-2}+\Delta N_{n-2}$ in order to increase the interstand tension between stands $N_{n-2}$ and $N_{n-1}$ then the speed $N_n$ is changed to $\Delta N_n+\Delta_n$ and $\Delta N_n=\Delta N_{n-1}$.

The input to the each cascaded non-inverting summation operational amplifier includes a scale factor or multiplier K which sets the range for the change in speed for each section respectively.

4 Claims, 7 Drawing Figures

PROCESS LINE PROGRESSIVE DRAW CONTROL SYSTEM

BACKGROUND OF THE INVENTION

1. Field of the Invention

This invention relates to a progressive draw control system for a process line.

2. Description of the Prior Art

In a process line, such as paper, for example, a strip of material is passed successively between sections or stands arranged in tandem. Each stand comprises at least a pair of opposed rollers through which the material is passed. Usually the sections or stands are driven by their own speed regulated motor. The basic production speed is set by a master reference voltage which is sent to each section or stand speed regulator where a vernier control is arranged to modify the master reference voltage to provide the desired section or stand speed. The speed difference between stands in the paper industry is called draw and the vernier control (usually a potentiometer) is called draw control.

In such a process line it is important to maintain constant tension in the strip between sections or stands at all time. Perturbations occur which effect interstand tension whenever either the basic production speed, i.e., the master voltage reference, is changed, or a discrete section speed is changed in order to increase the tension between any two sections or stands.

The prior art has been able to cope with disturbances resulting from changes in line voltage, i.e., changes in the basic production speed. The perturbations resulting from changes in section speed in order to increase tension, however have either not been mitigated at all or, where some sort of solution has been achieved, it applied only to a special situation, i.e. the solution did not satisfy the general case. The prior art solutions are discussed in depth hereinafter under the caption "General Considerations."

SUMMARY OF THE INVENTION

A progressive draw controller for a process line having a plurality of stands, includes a first no-draw stand control having a speed regulating means with a master reference voltage V applied thereto. A second stand control has a second speed regulating means and means for generating a second stand voltage $V_2$ derived from a preselected potential value linearly variable between +V and −V. The second voltage $V_2$ is coupled to the second stand speed regulation means. Each succeeding stand control has an associated speed regulating means and means for generating a stand voltage for that stand derived from a potential value linearly variable between +V and −V preselected for that stand and from the stand voltage generated by voltage generating means associated with the next preceding stand. The stand voltage for each stand is applied to the speed regulating means for that stand.

A draw control system for a process line is provided wherein the process line comprises a number of stand or sections having the speeds $N_1$, $N_2$–$N_n$. The stands are provided with a master reference voltage V which may be modified at each section to change its speed to $N_n+\Delta N_n$ where n=1–2, 3–n. One section is selected as a no-draw section, i.e. the master voltage is applied without change to the speed regulator for that section to determine its speed, say $N_1$. All succeeding sections comprise non-inverting summation operational amplifiers arranged in cascade respectively so that the output of one determines the speed for its section and this output is also applied to the input of the non-inverting summation amplifier for the succeeding section. With this arrangement all perturbations ripple on through the draw control system so that interstand tension is maintained under all conditions. Thus, if the master reference voltage is changed to V+ΔV then $$\frac{\Delta N_1}{N_1} = \frac{\Delta N_n}{N_n} = \frac{\Delta V}{V}$$

and if $N_{n-2}$ is changed to $N_{n-2}+\Delta N_{n-2}$ in order to increase the interstand tension between stands $N_{n-2}$ and $N_{n-1}$ then the speed $N_n$ is changed to $N_n+\Delta_n$ and $\Delta N_n=\Delta N_{n-1}$.

The input to the each cascaded non-inverting summation operational amplifier includes a scale factor or multiplier K which sets the range for the change in speed for each section respectively.

GENERAL CONSIDERATIONS

In the processing of a strip of material, such as paper or steel for example, the material is passed successively through a number of sections, or stands, arranged in tandem. Usually the sections, or stands, are each driven by a separate speed regulated motor. In such a system the basic production speed, which may vary over a ten to one range, is set by a master reference voltage which is applied to each section. Since adjustments are required from time to time, a vernier control is provided for each section to modify locally the effect of the master reference voltage thereby to change stand speed. In the paper industry the speed difference between two successive stands is called draw, and the vernier control (usually accomplished by adjusting a potentiometer) is called draw control.

Figure 4:
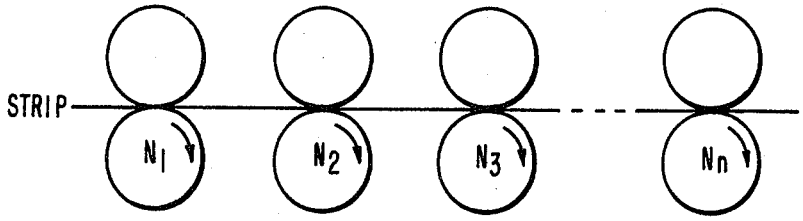
FIG. 4 is a pass line sketch of a process line system.

Referring now to the sketch of a pass line shown in FIG. 4, $N_1$, $N_2$, $N_3$–$N_n$ are the respective surface speeds of the rolls. Since the roll diameter is fixed, the surface speed is proportional to roll angular speed or motor r.p.m. The strip material is an elastic medium and as such it obeys Hooke's Law of stress/strain proportionality. In the dynamic case of a moving strip:

$$\Delta T = Et\Delta N_s \quad (1)$$

where

E=the modulus of elasticity (force per unit area)

t=the strip thickness and $\Delta N_s$=the surface speed difference between stands, i.e., $N_2-N_1$ or $N_n-N_{n-1}$ $\Delta T$ = the change in strip tension (force per unit width resulting from a change in speed $\Delta N_s$.

In any strip processing line, it is important to maintain proper interstand tension in order to avoid the formation of a loop with the strip caused by insufficient tension, or a break or tear of the strip as a result of excessive tension.

Progressive draw is achieved by automatic adjustment in stand speed to preserve the interstand tension between all stands in response to any perturbation arising from a change in the overall line speed, or a change in the speed at a discrete stand.

In order to provide a true progressive draw, the following criteria must be satisfied:

CONDITION #1:

If the line speed is changed, i.e., the master voltage reference V is adjusted, then, in order to maintain constant interstand tension, the per unit (p.u.) speed change must be the same for each section. Thus, $$\frac{\Delta N_1}{N_1} = \frac{\Delta N_2}{N_2} = \frac{\Delta N_3}{N_3} = \frac{\Delta V}{V}$$

CONDITION #2:

If the section speed is changed in order to increase the tension between any two stands, the speed of all other sections must increase by the same *absolute* magnitude of speed (not p.u.) in order to maintain interstand tension.

Thus, if the speed of section 2 is changed to $N_2+\Delta N_2$, in order to increase the tension between section 1 and section 2, the speed of $N_3$ must be changed to $N_3+\Delta N_3$, where $\Delta N_3=\Delta N_2$, in order to maintain the same tension between sections 2 and 3, as it existed before $N_2$ had been changed.

Figure 5:
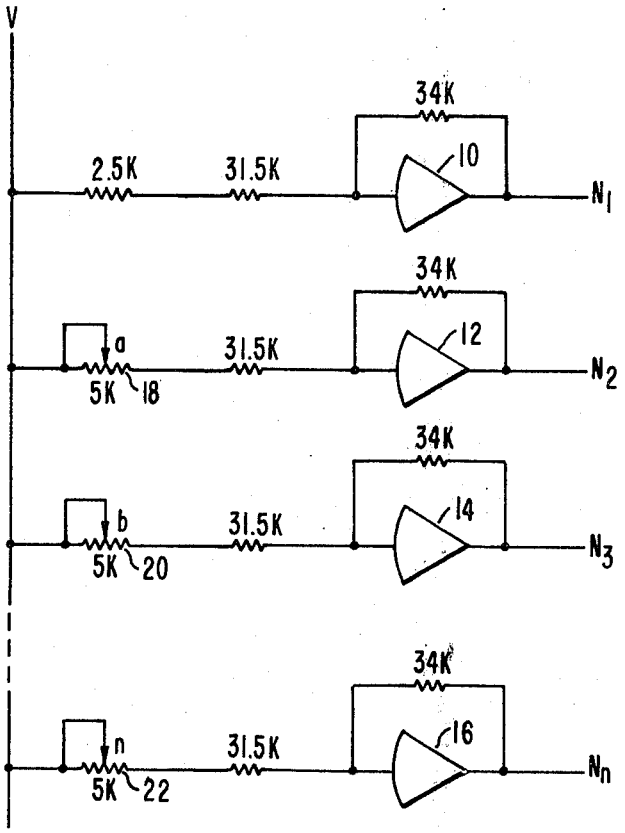
FIG. 5 PRIOR ART
FIG. 5 is a prior art draw control system.

A typical prior art reference generation circuit is shown in FIG. 5. Operational amplifiers are indicated symbolically at 10, 12, 14, and 16. The ohmic magnitudes given are typical values, shown only for illustrative purposes. Sections 2, 3, and $N_n$ include draw potentiometers 18, 20, and 22 at the input to respective operational amplifiers 12, 14, and 16. These are for the purpose of modifying the line reference voltage V. Taps a, b, c,-n of potentiometers 18, 20, and 22 define successive per unit rotation angles for the respective draw potentiometers. Typically, V has a value of 10 volts to produce rated roll surface speed N equal to 10 volts.

The equations for the section speeds of FIG. 5 as a function of the line reference voltage V and the draw potentiometer rotations are as follows:

SECTION 1

$$\frac{V}{2.5K + 31.5K} = \frac{N_1}{34K} \quad (2)$$

$$\therefore N_1 = V \quad (3)$$

SECTION 2

$$\frac{V}{31.5K + 5K(1 - a)} = \frac{N_2}{34K} \quad (4)$$

$$N_2 = \frac{34KV}{31.5K + 5K(1 - a)} \quad (5)$$

$$N_2 = \frac{6.8V}{6.3 + (1 - a)} \quad (6)$$

-continued $$N_2 = \frac{6.8V}{7.3 - a} \quad (7)$$

The mathematics are essentially the same for section 3 and section $N_n$ and need not be repeated.

SECTION 3

$$N_3 = \frac{6.8V}{7.3 - b} \quad (8)$$

SECTION $N_n$ $$N_n = \frac{6.8V}{7.3 - n} \quad (9)$$

Referring to FIG. 5 it will now be determined whether the system meets the criteria for a true progressive draw, i.e. whether it satisfy conditions #1 and #2 supra.

If the potentiometers are all held at the same position, and V is changed to $V+\Delta V$, this will cause $N_1 \rightarrow N_1+\Delta N_1$; $N_2 \rightarrow N_2+\Delta N_2$ and $N_n \rightarrow N_n+N_n$.

SECTION 1

$$N_1 + \Delta N_1 = V + \Delta V \quad (10)$$

since $N_1 = V$ $$\Delta N_1 = \Delta V \text{ and} \quad (11)$$

$$\frac{\Delta N_1}{N_1} = \frac{\Delta V}{V} \quad (12)$$

SECTION 2

$$N_2 + \Delta N_2 = \frac{6.8(V + \Delta V)}{7.3 - a} \quad (13)$$

$$\Delta N_2 = \frac{6.8\,\Delta V}{7.3 - a} \quad (14)$$

$$\frac{\Delta N_2}{N_2} = \frac{\dfrac{6.8\,\Delta V}{7.3 - a}}{\dfrac{6.8V}{7.3 - a}} \quad (15)$$

$$\frac{\Delta N_2}{N_2} = \frac{\Delta V}{V} \quad (16)$$

The mathematics are the same for section 3 and section $N_n$ and need not be repeated. The results are:

SECTION 3

$$N_3 + \Delta N_3 = \frac{6.8(V + \Delta V)}{7.3 - b} \quad (17)$$

$$\frac{\Delta N_3}{N_3} = \frac{\Delta V}{V} \quad (18)$$

SECTION $N_n$ $$N_n + \Delta N_n = \frac{6.8(V + \Delta V)}{7.3 - n} \quad (19)$$

$$\frac{\Delta N_n}{N_n} = \frac{\Delta V}{V} \quad (20)$$

This shows that condition #1 is satisfied. Thus, for line speed changes, each section experiences the same change per unit (p.u.) so that intersection or interstand tension will remain constant.

By adjusting "a," $N_2$ will be changed accordingly, and similarly adjusting "b" will produce the required change in $N_3$. Obviously, changing one however does not change the others. Therefore, if "a" is changed to increase the intersection tension between sections 1 and 2, unless the operator adjusts all the following draw potentiometers to cause each section speed to change the same amount, the remaining intersectional tensions will change.

In the manual system, the operator was the key to success. However, in changing all the draw potentiometers achieving the correct amount was fortuitous, the operation was time consuming, and prone to error. Nevertheless, even with these deficiencies the manual system worked fairly well at low speeds (i.e. less than 1000 feet per minute) where few sections are involved.

With the advent of faster machines of many sections, the operator could not keep up with manual adjustments. It therefore became necessary to provide progressive draw control so that when a section draw was changed all succeeding section draws could be changed simultaneously. The term regressive draw also is used in the art. In the examples given hereinafter the lead or no draw section is assumed to be the first section of the machine while the draw progresses downstream. Often, however, the lead section is placed in the middle of the process line so that the draw is both regressive upstream and progressive downstream. This is merely a convention, though, since a negative progressive draw is the same as a positive regressive draw. By proper connections this is taken care of and general principles remain the same whatever the initial assumption.

In the prior art, the first progressive draw system, along a modification of the configuration of FIG. 5, used a universal type motor to drive the draw potentiometers. When one motor was energized by the operator, all downstream units were also energized to change the tap or slide on each potentiometer by the same amount. Since the speed of the universal motors could not be synchronized, this arrangement was modified by using a stepping motor to drive each draw potentiometer. Since the stepping motors were operated from the same a.c. line, synchronization was assured.

Considering FIG. 5 where the draw potentiometers are driven by stepping motors, it is clear from the previous explanation that condition #1 will be satisfied with this latter arrangement. Now let V be held constant and let's move the tap from position a to position a+Δa. This of course will change $N_2$ to $N_2+\Delta N_2$ where $N_1$ remains constant.

$$N_2 + \Delta N_2 = \frac{6.8V}{7.3 - (a + \Delta a)} \tag{21}$$

$$\Delta N_2 = \frac{6.8V}{7.3 - a - \Delta a} - N_2 \tag{22}$$

$$\Delta N_2 = \frac{6.8V}{7.3 - a - \Delta a} - \frac{6.8V}{7.3 - a} \tag{23}$$

$$\Delta N_2 = \frac{6.8V(7.3 - a) - 6.8V(7.3 - a - \Delta a)}{(7.3 - a)(7.3 - a - \Delta a)} \tag{24}$$

$$\Delta N_2 = \frac{6.8V\Delta a}{(7.3 - a)(7.3 - a - \Delta a)} \tag{25}$$

With the same mathematics for section 3, since the draw potentiometer must increase by the same amount, draw potentiometer for section 3 changes from top position b to top position b+Δa.

$$\Delta N_3 + \Delta N_3 = \frac{6.8V}{7.3 - (b + \Delta a)} \tag{26}$$

$$\Delta N_3 = \frac{6.8V\Delta a}{(7.3 - b - \Delta a)(7.3 - b)} \tag{27}$$

For condition #2 to be satisfied $\Delta N_3$ must equal $\Delta N_2$ (See the discussion supra regarding condition #2).

$$\frac{\Delta N_2}{\Delta N_3} = \frac{\dfrac{6.8V\Delta a}{(7.3 - a)(7.3 - a - \Delta a)}}{\dfrac{6.8V\Delta a}{(7.3 - b - \Delta a)(7.3 - b)}} \tag{28}$$

$$\frac{\Delta N_2}{\Delta N_3} = 1 = \frac{(7.3 - b - \Delta a)(7.3 - b)}{(7.3 - a)(7.3 - a - \Delta a)} \tag{29}$$

The condition $\Delta N_2/\Delta N_3=1$ is satisfied, if and only if, b=a or b=(a+Δa−14.6).

Since $\Delta N_2=\Delta N_3$ only under these conditions, this is a unique case. In the general case, condition 2 is not met. It is noted also that N is not linear with respect to the rotation of the draw potentiometer.

Figure 6:
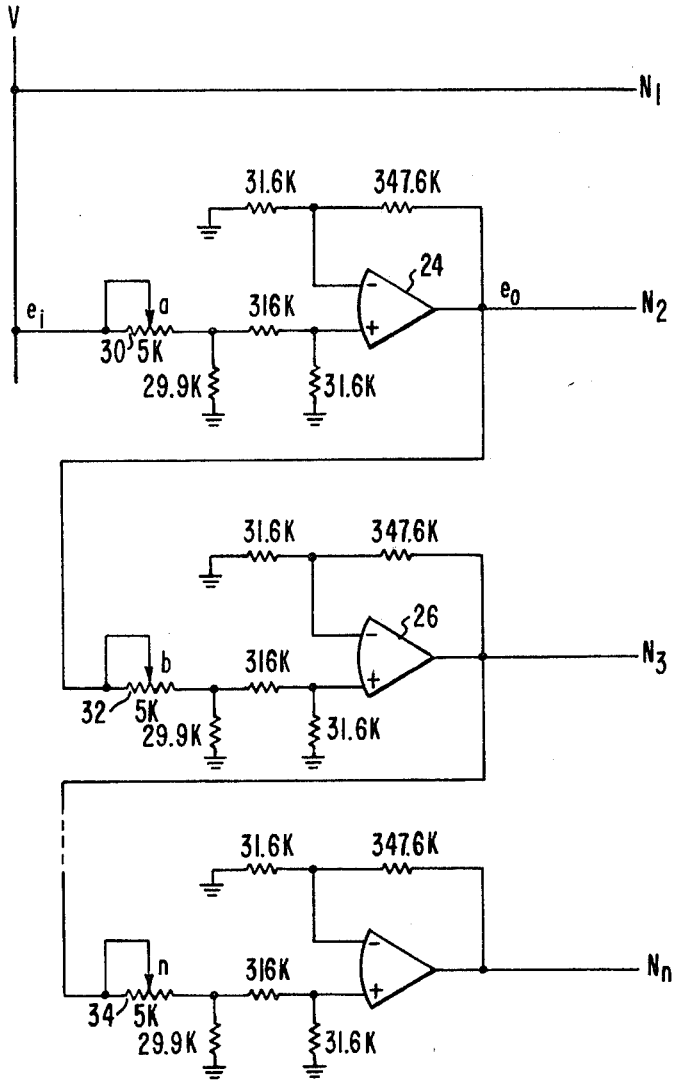
FIG. 6 PRIOR ART
FIG. 6 is a prior art draw control system.

The next step in the prior art was to eliminate the stepping motor and use the cascaded operational amplifier arrangement shown in FIG. 6. As depicted in FIG. 6, section 1 is a no draw section, and the master reference V goes directly to the motor regulating the speed for section 1. The reference V is also applied to the input of operational amplifier 24 which is modified to $e_i$ by means of draw potentiometer 30. The output $e_0$ for section 2 is $$e_o = \frac{6}{6.5 - a} e_i \tag{30}$$

Figure 7:
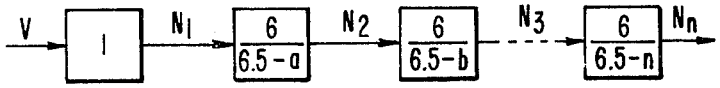
FIG. 7 PRIOR ART
FIG. 7 is a simplified block diagram to facilitate the understanding of the prior art draw control system of FIG. 6.

The cascaded operation amplifier arrangement of FIG. 6 can be reduced to the simple block diagram of FIG. 7.

Referring to FIG. 7, the cascaded operational amplifier arrangement of FIG. 6 will now be considered to determine whether or not it satisfies conditions 1 and 2 for a true progressive draw.

CONDITION #1

Let V become V+ΔV while a, b–n are held constant.

SECTION 1

$$N_1 + \Delta N_1 = V + \Delta V \tag{31}$$

$$\frac{\Delta N_1}{N_1} = \frac{\Delta V}{V} \tag{32}$$

SECTION 2

$$N_2 + \Delta N_2 = \frac{(N_1 + \Delta N_1)6}{6.5 - a} \tag{33}$$

$$N_2 = \frac{6N_1}{(6.5 - a)} \tag{34}$$

$$\therefore \Delta N_2 = \frac{6\Delta N_1}{(6.5 - a)} \tag{35}$$

-continued $$\frac{\Delta N_2}{N_2} = \frac{\dfrac{6\Delta N_1}{(6.5 - a)}}{\dfrac{6N_1}{(6.5 - a)}} \tag{36}$$

$$\frac{\Delta N_2}{N_2} = \frac{6\Delta N_1}{6N_1} = \frac{\Delta N_1}{N_1} \tag{37}$$

Similarly for

SECTION 3

$$\frac{\Delta N_3}{N_3} = \frac{\Delta N_2}{N_2} \tag{38}$$

SECTION $N_n$ $$\frac{\Delta N_n}{N_n} = \frac{\Delta N_{n-1}}{N_{n-1}} \tag{39}$$

Thus $$\frac{\Delta V}{V} = \frac{\Delta N_1}{N_1} = \frac{\Delta N_2}{N_2} = \frac{\Delta N_3}{N_3} \cdots \frac{N_n}{N_n} \tag{40}$$

Which satisfies condition #1.

In order to check condition #2, V, and all the draw potentiometers are held constant except 30, i.e. the "a" draw potentiometer.

Thus let a become a+Δa.

For SECTION 1

$$N_1 = V \tag{41}$$

SECTION 2

$$N_2 + \Delta N_2 = \frac{6N_1}{6.5 - (a + \Delta a)} \tag{42}$$

$$N_2 = \frac{6N_1}{6.5 - a} \tag{43}$$

$$N_2 = \frac{6N_{1\Delta a}}{(6.5 - a)(6.5 - a - \Delta a)} \tag{44}$$

For SECTION 3

$$N_3 + \Delta N_3 = \frac{6\,N_2 + \Delta N_2}{6.5 - b} \tag{45}$$

$$\Delta N_3 = \frac{6\,N_2 + \Delta N_2}{6.5 - b} - N_3 \tag{46}$$

$$\Delta N_3 = \frac{36N_1\,\Delta a}{(6.5 - b)(6.5 - a)(6.5 - a - \Delta a)} \tag{47}$$

$$\frac{\Delta N_2}{\Delta N_3} = \frac{\dfrac{6N_1\Delta a}{(6.5 - b)(6.5 - a)(6.5 - a - \Delta a)}}{\dfrac{36N_1\Delta a}{(6.5 - b)(6.5 - a)(6.5 - a - \Delta a)}} \tag{48}$$

$$\frac{\Delta N_2}{\Delta N_3} = \frac{(6.5 - b)}{6} \tag{49}$$

The ratio $\Delta N_2/\Delta N_3$ is equal to unity, if and only if, b=0.5. This is a unique condition indicating that $\Delta N_3 \neq \Delta N_2$ in the general case.

The system of FIG. 6 performs well enough where "a" is close to "b." However, with the cascaded system of FIG. 6, the error became worse with the addition of each succeeding section. Further, since the draw is non-linear in relation to p.u. potentiometer rotation, the errors are further magnified. In regard to performance, the arrangement of FIG. 6, does not possess very much operational advantage over the arrangement of FIG. 5. However, the cascaded operational amplifier arrangement of FIG. 5 is less complex and less expensive to manufacture.

DESCRIPTION OF THE PREFERRED EMBODIMENT

The invention will now be described by reference to FIGS. 1 and 2. Before describing the invention, some mathematical equations need to be developed for the non-inverting summation amplifier 36 depicted in FIG. 3.

Figure 3:
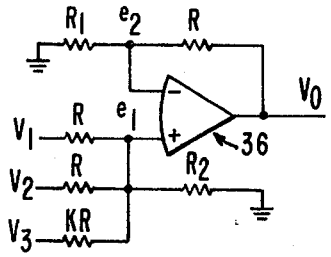
FIG. 3 is a block diagram used in analyzing the non-inverting summation amplifier shown in FIGS. 1 and 2.

Referring, thus, to FIG. 3, the non-inverting summation amplifier 36 has two inputs, a positive summing input and a negative summing input. Let $e_1$ be the input to the positive summing junction input. Summing the currents in and the currents out:

$$\frac{V_1 - e_1}{R} + \frac{V_2 - e_1}{R} + \frac{V_3 - e_1}{KR} = \frac{e_1}{R_2} \tag{50}$$

Let $e_2$ be the input to the negative summing junction, then:

$$e_1 = e_2 = e \tag{52}$$

$$\frac{V_1}{R} - \frac{e}{R} + \frac{V_2}{R} - \frac{e}{R} + \frac{V_3}{KR} - \frac{e}{KR} = \frac{e}{R_2} \tag{53}$$

$$\frac{V_1}{R} + \frac{V_2}{R} + \frac{V_3}{KR} = e\frac{1}{R_2} + \frac{1}{R} + \frac{1}{R} + \frac{1}{KR} \tag{54}$$

$$\frac{V_1}{R} + \frac{V_2}{R} + \frac{V_3}{KR} = e\frac{1}{R_2} + \frac{2}{R} + \frac{1}{KR} \tag{55}$$

$$\frac{V_0}{R} - \frac{e}{R} = \frac{e}{R_1} \tag{56}$$

$$\frac{V_0}{R} = e\frac{1}{R_1} + \frac{1}{R} \tag{57}$$

$$\text{LET } \frac{1}{R_1 + R} = \frac{1}{R_2} + \frac{2}{R} + \frac{1}{KR} \tag{58}$$

$$\frac{V_0}{R} = \frac{V_1}{R} + \frac{V_2}{R} + \frac{V_3}{KR} \tag{59}$$

$$\therefore V_0 = V_1 + V_2 + \frac{V_3}{K} \tag{60}$$

Since this is an operational amplifier: $e_1 = e_2$. The summing junction voltages have to be equal to have infinite gain, etc.

$$\frac{V_0 - e_2}{R} = \frac{e_2}{R_1} \tag{51}$$

Figure 1:
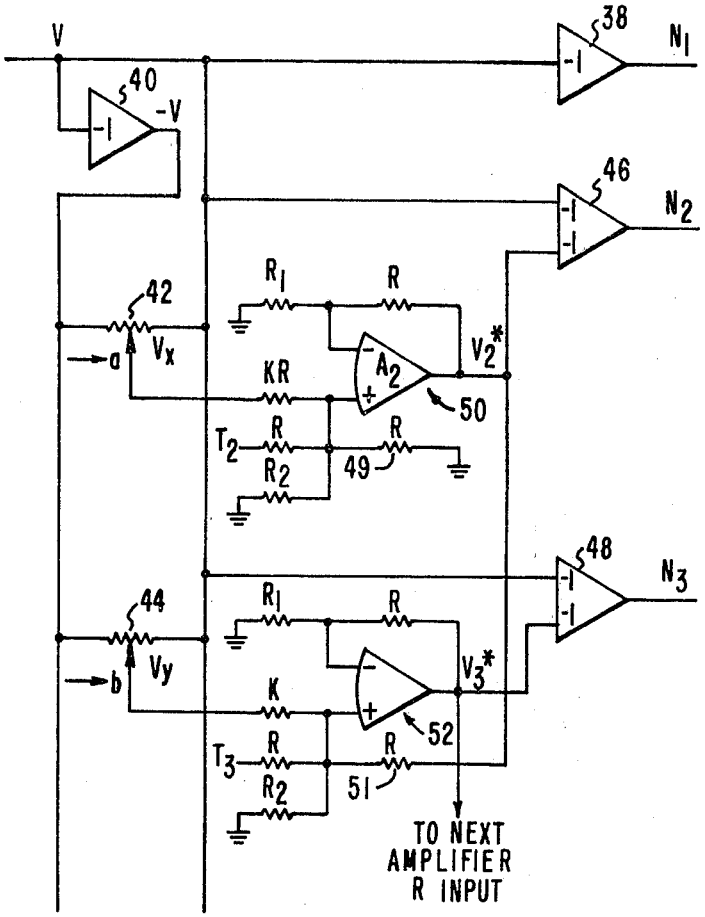
FIG. 1 is a simplified electrical schematic of the draw control system in accordance with the invention.

Referring now to FIG. 1, for the non-draw section, i.e. section 1, the master reference V is connected to inverting amplifier 38. The master reference V is also connected to inverting amplifier 40, the inverted output of which is applied to one end of draw potentiometer 42, which serves section 2, and one end of draw potentiometer 44 which belongs to section 3. The master reference V is further connected via a common junction point to an input of inverting summing amplifier 46 and an input of summing amplifier 48. A non-inverting summation operational amplifier for section 2 is indicated generally at 50. Similarly, a non-inverting summation operational amplifier indicated generally at 52, is provided for section 3.

The non-inverting summing operational amplifiers 50 and 52 reproduce to the mathematical model shown in FIG. 3. Referring now to the non-inverting summing operational amplifier 50, the KR resistor in the positive input junction is connected to the tap or sider on draw potentiometer 42. $V_X$, the portion of the voltage between the tap on the draw potentiometer 42 and the master reference V, is thus equivalent to $V_3$ of the FIG. 3 embodiment. The R resistor is connected to a voltage source which is identified as $T_2$ (this is equivalent to $V_1$ of FIG. 3). The $R_2$ resistor is grounded like in the FIG. 3 model, and R (49) is returned to ground as the equivalent to potential $V_2$ of FIG. 3, thus, $V_2=0$.

The non-inverting summing operational amplifier 52 for section 3 is slightly different in that R resistor 51 is connected to $V_2$*, namely the output of the non-inverting summing operational amplifier 50. The KR resistor is connected to the tap of the draw potentiometer 44, thus providing $V_y$ which is equivalent to $V_3$ of FIG. 3. The R resistor is connected to $T_3$ which is equivalent to $V_1$ of FIG. 3. In all the succeeding sections the output of a preceding non-inverting summing operational amplifier is connected to the corresponding R resistor (cf 49 and 51 of sections 2 and 3) of a succeeding non-inverting summing operational amplifier.

In the FIG. 1 embodiment, if the $T_2$ and $T_3$ inputs are zero, the following equations hold:

$$N_1=V \tag{61}$$

$$V_x=V(2a-1) \tag{62}$$

Equation (62) can be proven as follows: The potentiometer 42 is between V and −V potentials. If tap "a" is all the way to the left as viewed in FIG. 1, then a=0 and $V_x=-V$. If tap "a" is all the way to the right, then, a=1 and $V_x=V$. If tap "a" is exactly in the middle, $a=\frac{1}{2}$ and $V_x=0$.

Also,:

$$V_y=V(2b-1) \tag{63}$$

Equation (63) can be proven as follows: If tap "b" is all the way to the left as viewed in FIG. 1, then b=0 and $V_y=V$. If tap "b" is all the way to the right as viewed in FIG. 1, b=1, $V_y=-V$.

Therefore, the following equations obtain:

$$V_2^* = \frac{V_x}{K} = \frac{V(2a-1)}{K} \tag{64}$$

$$N_2 = V + V_2^* = V + \frac{V(2a-1)}{K} = V\left(1+\frac{(2a-1)}{K}\right) \tag{65}$$

$$V_3^* = V_2^* + \frac{V_y}{K} = \frac{V(2a-1)}{K} + \frac{V(2b-1)}{K} \tag{66}$$

$$N_3 = V_3^* + V = V + \frac{V(2b-1)}{K} + \frac{V(2a-1)}{K} \tag{67}$$

$$N_n = V\left(1+\frac{2n-1}{K}\right) \cdots\cdots \frac{2b-1}{K} + \frac{2a-1}{K} \tag{68}$$

where n is the number of stages, e.g.=1, 2, 3–.

As already stated, for a true progressive draw, the circuit of FIG. 1 must satisfy conditions #1 and #2.

CONDITION #1

Let all draw potentiometers be fixed and let V become V+ΔV. Then, $$N_1 = V \tag{69}$$

$$N_1 + \Delta N_1 = V + \Delta V \tag{70}$$

$$\Delta N_1 = V + \Delta V - V \tag{71}$$

$$\Delta N_1 = \Delta V \tag{72}$$

$$\frac{\Delta N_1}{N} = \frac{\Delta V}{V} \tag{73}$$

$$N_2 + \Delta N_2 = (V+\Delta V)\left(1+\left(\frac{2a-1}{K}\right)\right) \tag{74}$$

$$\Delta N_2 = V + \Delta V + V\left(\frac{2a-1}{K}\right) + \Delta V\left(\frac{2a-1}{K}\right) - V - V\left(\frac{2a-1}{K}\right) \tag{75}$$

$$\Delta N_2 = \Delta V\left(1+\frac{2a-1}{K}\right) \tag{76}$$

$$N_2 = V\left(1+\frac{2a-1}{K}\right) \tag{77}$$

$$\therefore \frac{\Delta N_2}{N_2} = \frac{\Delta V}{V} \tag{78}$$

In a like manner:

$$\frac{\Delta N_3}{N_3} = \frac{\Delta N_n}{N_n} = \frac{\Delta V}{V} \tag{79}$$

Thus, the arrangement satisfies condition #1. It is observed that the draw follows linearly by the potentiometer position.

CONDITION #2

In order to verify condition #2, V is held constant, tap "a" is varied while taps "b"–n are held constant. Thus, the change causes a to be a+Δa. It follows:

$$N_2 + \Delta N_2 = V\left(1+\frac{2(a+\Delta a)-1}{K}\right) \tag{80}$$

$$= V\left(1+\frac{(2a-1)}{K}+\frac{2\Delta a}{K}\right) \tag{81}$$

$$N_2 = V\left(1+\frac{(2a-1)}{K}\right) \tag{82}$$

$$\therefore N_2 = \frac{2\Delta a}{K} \tag{83}$$

$$N_3 + \Delta N_3 = V + V\frac{(2a-1)}{K} + V\frac{(2b-1)}{K} + \frac{2\Delta a}{K} \tag{84}$$

-continued $$N_3 = V + V\left(\frac{2b-1}{K}\right) + V\left(\frac{2a-1}{K}\right) \quad (85)$$

$$\therefore \Delta N_3 = \frac{2\Delta a}{K} \quad (86)$$

$$\Delta N_3 = \Delta N_2 \quad (87)$$

$$N_i = \Delta N_i = V\left(1 + \frac{2a-1}{K}\right) + \frac{2b-1}{K} \cdots \frac{2i-1}{K} + \frac{2\Delta a}{K} \quad (88)$$

$$\text{or } N_i = \frac{2\Delta a}{K} \quad (89)$$

Figure 2:
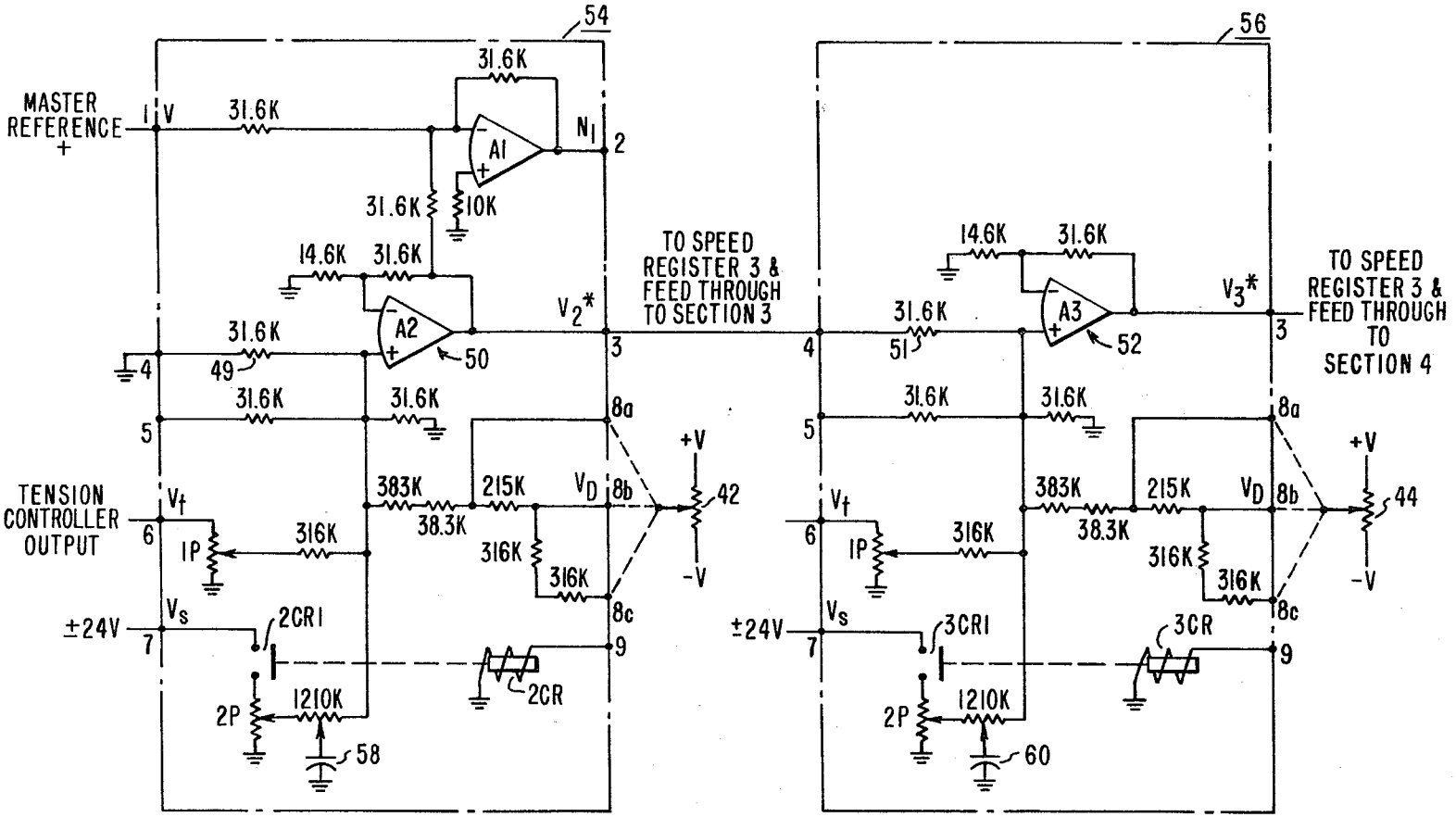
FIG. 2 is a more detailed electrical schematic of the draw control system in accordance with the invention.

FIG. 2 shows how sections 1, 2, and 3 of a process line are connected in a practical embodiment. The inverting summing amplifiers, the non-inverting summing amplifiers and the resistors are arranged on printed circuits, cards or boards, as indicated generally at 54 and 56 for sections 2 and 3 respectively. Some additional components are shown in the interest of illustrating a practical embodiment. These will be explained as the description proceeds.

Boards 54 and 56 are each provided with terminals 1, 2, 3, 4, 5, 6, 7, 8*a*, 8*b*, 8*c* and 9. On board 54, terminal 1 is connected to the master reference voltage V. On board 54 terminal 2 provides the signal $N_1$ which is the speed regulator reference for section 1. On each board, terminal 3 is fed through to the next section; thus, as shown in FIG. 2, terminal 3 of board 54 is connected to terminal 4 of board 56. Terminal 3 of board 56 is connected to the next section, i.e. section 4 at the terminal 4 thereof.

Terminal 4 of board 54 is grounded because its preceding section is section 1, a no-draw section. This agrees with FIG. 1 where resistor 49 of non-inverting summing amplifier 50 is grounded, while its counterpart resistor 51 of non-inverting summing amplifier 52 is connected so as to respond to $V_2$* from amplifier 50. Terminal 5 of each board is a spare input, which is grounded if it is not used. Terminal 6 of board 54 is connected to the output $V_t$ of a tension controller for the section. Terminal 6 of board 56 may also be connected to the output of a tension controller for section 3. The word "may" is used here because in many process lines, those involving paper as material for example, every section does not have its own tension controller.

For each board, the output $V_t$ at terminal 6, is connected to one end of a potentiometer 1P, the other end of which is grounded. The slide of the potentiometer 1P is connected through a 31.6K resistor to the input of the respective non-inverting summing operational amplifier i.e. 50 and 52.

Terminal 7 of board 54 is connected to a voltage source such as ±24 V, and applied to one end of potentiometer 2P through normally open contacts 2CR1; the other end of potentiometer 2P is connected to ground. The slide of potentiometer 2P is connected to a 1210K resistor and a capacitor 58 connected in parallel to the input of non-inverting summing operational amplifier 50. (The RC constant provides a 100 millisecond delay.) Similarly, terminal 7 of board 56 is connected to one end of a potentiometer 2P through normally open contacts 3CR1, the other end of potentiometer 2P being grounded. The slide of 2P is connected to a 1210K resistor and a capacitor 60, connected in parallel to the input of non-inverting summing operational amplifier 52. (The RC constant provides a 100 millisecond delay.)

The slide of draw potentiometer 42 for section 2 may be connected to one of terminals 8*a*, 8*b* or 8*c*. Similarly, the slide of draw potentiometer 44 may be connected to one of terminals 8*a*, 8*b* or 8*c*.

Coil 2CR on board 54 is connected to a voltage source (not shown) through a push button (not shown). Similarly coil 3CR on board 56 is connected to a voltage source (not shown) through a push button (not shown). When any one of these buttons is pressed by an operator, a corresponding coil, i.e. 2CR, or 3CR, is energized, causing the normally open corresponding contacts, 2CR1 or 3CR1, to close.

Terminal 4 (when not grounded) provides unity gain for the output at terminal 3. Similarly, terminal 5 provides unity gain for the output at terminal 3. (The ratio of the feedback and input resistors is one, i.e. 31.6K/31.6K. The output at terminal 3 for an input at terminal 6 depends on the location of the slide of potentiometer 1P. If the slide is all the way to the bottom, the gain is zero. If the slide of 1P is all the way to the top, the gain is 1/10, i.e. 31.6/31.6. At terminal 7 if the slider of 2P is all the way to the bottom, the gain is zero. If the slider of 2P is all the way to the top, the gain is 0.0261, i.e. 31.6K/1210K.

The connection of the slide of the draw potentiometer, 42, or 44, to 8*a*, 8*b* and 8*c*, respectively, provides a means for adjusting the scale factor or multiplier K. If a slider is connected to 8*a* the ratio is 31.6K/421.3K for a gain of ±7½%. If a slider is connected to 8*b* the ratio is 31.6/636.3 for a gain of ±5%. If a slider is connected to 8*c* the gain is given by 31.6K/1268.3K, e.g. ±2.5%.

What is claimed is:

1. A progressive draw controller for a process line having a plurality of stands, said controller comprising:

a first no-draw stand control having a speed regulating means with a master reference voltage V applied thereto, a second stand control having a second speed regulating means and having means for generating a second stand voltage $V_2$ derived from a preselected potential value linearly variable between +V and −V, said second voltage $V_2$ being applied to the second stand speed regulation means, and each succeeding stand control having an associated speed regulating means and having means for generating a stand voltage for that stand derived from a potential value linearly variable between +V and −V preselected for that stand and from the stand voltage generated by said voltage generating means associated with the next preceding stand, the stand voltage for each stand being applied to the speed regulating means for that stand.

2. A progressive draw controller for a process line consisting of a plurality of stands 1, 2, 3–n, each stand including a speed regulating means to control the stand speed and including a master reference voltage V, said controller comprising:

a first no-draw stand control wherein the master reference voltage V is applied directly to the speed regulating means for the first stand, a second stand control comprising a second stand summing operational amplifier having input and output terminals for providing an output signal $V_2$* which is coupled to the speed regulating means for the second stand and to the input terminals of a summing operational amplifier for the third stand control, a draw potentiometer for said second stand connected between +V and −V and having a slider connected to the input terminals for said second stand summing operational amplifier, a stand control for each subsequent stand through (n−1) comprising a (n−1)th summing operational amplifier having input and output terminals providing an output signal $V_{n-1}$*, said output signal $V_{n-1}$* being coupled to the speed regulating means for the (n−1)th stand control, the input terminals of said (n−1)th operational amplifier receiving an output signal $V_{n-2}$* from the preceding (n−2)th stand, a draw potentiometer for said (n−1)th stand control connected between +V and −V and having a slider connected to the input terminals of said (n−1)th operational amplifier, a nth stand control comprising a nth summing operational amplifier having input and output terminals and providing an output signal $V_n$*, said output signal $V_n$* being coupled to the speed regulating means for the nth stand, the output signal $V_{n-1}$* from the (n−1)th stand control being connected to the input terminals of the nth operational amplifier, a draw potentiometer for said nth stand connected between +V and −V, the slider connected to the input terminals of said nth operational amplifier.

3. A progressive draw controller according to claim 2 wherein, at least one stand (2–n) has its respective operational amplifier (2–n) connected to receive an additional voltage input signal which affects the output $V_{(2-n)}$ of said respective operational amplifier (2–n).

4. A progressive draw controller according to claim 2 wherein, at each stand (2–n), a multi-input terminal resistor network is interposed between the slider of the respective stand draw potentiometer (2–n) and the input terminals for the stand (2–n) operational amplifier, whereby connecting the slider to one of said multi-input terminals determines the scale factor K for the appropriate operational amplifier (2–n).

* * * * *